US008506364B2

(12) United States Patent
Beyer et al.

(10) Patent No.: US 8,506,364 B2
(45) Date of Patent: Aug. 13, 2013

(54) ABRASIVE ARTICLE HAVING A LINE OF WEAKNESS

(75) Inventors: Timothy T. Beyer, Nuneaton (GB); Brant A. Moegenburg, Baldwin, WI (US); Mark A. Swanson, Ames, IA (US); Schoen A. Schuknecht, Hudson, WI (US); Charles R. Wald, Oakdale, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 310 days.

(21) Appl. No.: 12/869,061

(22) Filed: Aug. 26, 2010

(65) Prior Publication Data

US 2011/0053476 A1 Mar. 3, 2011

Related U.S. Application Data

(60) Provisional application No. 61/237,947, filed on Aug. 28, 2009.

(51) Int. Cl.
*B23K 26/00* (2006.01)
*B24D 11/00* (2006.01)

(52) U.S. Cl.
USPC .. 451/539; 451/526; 219/121.71; 219/121.69

(58) Field of Classification Search
USPC ..... 451/526–539; 428/43
IPC ..... B24D 11/00, 11/02, 11/04
See application file for complete search history.

(56) References Cited

U.S. PATENT DOCUMENTS

| | | | | | |
|---|---|---|---|---|---|
| 3,143,208 | A | * | 8/1964 | Sizemore, Jr. | 428/43 |
| 3,994,409 | A | * | 11/1976 | Nightengale, Jr. | 215/256 |
| 4,109,500 | A | * | 8/1978 | Franek | 72/203 |
| 4,298,647 | A | * | 11/1981 | Cancio et al. | 428/167 |
| 4,356,375 | A | * | 10/1982 | Josephy et al. | 219/121.68 |
| 4,465,729 | A | * | 8/1984 | Cancio et al. | 428/167 |
| 4,537,809 | A | * | 8/1985 | Ang et al. | 428/42.2 |
| 4,781,957 | A | * | 11/1988 | Brown et al. | 428/43 |

(Continued)

FOREIGN PATENT DOCUMENTS

| | | |
|---|---|---|
| AU | 2004100059 | 3/2004 |
| WO | WO 0124971 | 4/2001 |

(Continued)

OTHER PUBLICATIONS

U.S. Appl. No. 61/289,094, entitled 'Flexible Abrasive Article and Methods of Making, filed Dec. 22, 2009.

(Continued)

*Primary Examiner* — Lee D Wilson
*Assistant Examiner* — Tyrone V Hall, Jr.
(74) *Attorney, Agent, or Firm* — Aleksander Medved

(57) ABSTRACT

A coated abrasive article (1) comprises a backing (3) having an abrasive coating (5) on one side, an attachment layer (7) on the other side of the backing, and a line of weakness (9) that does not penetrate the front face of the abrasive coating (5). The line of weakness, which may be formed using a laser beam, comprises a through-cut (11) in the attachment layer (7) and perforations (13) in the backing (3), and permits one part of the abrasive article (1) to be separated from another part. Alternatively, the abrasive article can be used in its original form.

13 Claims, 2 Drawing Sheets

(56) References Cited

U.S. PATENT DOCUMENTS

| | | | | |
|---|---|---|---|---|
| 5,152,917 | A | 10/1992 | Pieper et al. | |
| 5,183,479 | A * | 2/1993 | Grimes | 51/293 |
| 5,616,387 | A * | 4/1997 | Augst et al. | 428/43 |
| 5,712,210 | A * | 1/1998 | Windisch et al. | 442/320 |
| 6,294,124 | B1 * | 9/2001 | Bauer et al. | 264/400 |
| 6,755,878 | B2 * | 6/2004 | Paxton et al. | 51/298 |
| 2003/0051440 | A1 * | 3/2003 | Chow et al. | 53/412 |
| 2004/0020133 | A1 | 2/2004 | Paxton et al. | |
| 2005/0107019 | A1 | 5/2005 | Lee | |
| 2005/0170765 | A1 * | 8/2005 | Shermer et al. | 451/538 |
| 2005/0227600 | A1 * | 10/2005 | Fisher | 451/538 |
| 2008/0216414 | A1 | 9/2008 | Braunschweig et al. | |

FOREIGN PATENT DOCUMENTS

| | | |
|---|---|---|
| WO | WO 2004012906 | 2/2004 |
| WO | WO 2007021636 | 2/2007 |
| WO | WO 2009/013280 | 1/2009 |

OTHER PUBLICATIONS

International Search Report from International Application No. PCT/US2010/046770.

* cited by examiner

ABRASIVE ARTICLE HAVING A LINE OF WEAKNESS

CROSS REFERENCE TO RELATED APPLICATION

This application claims the benefit of U.S. Provisional Patent Application No. 61/237,947, filed Aug. 28, 2009, the disclosure of which is incorporated by reference herein in its entirety.

TECHNICAL FIELD

The present invention relates to abrasive articles, in particular coated abrasive articles, and to methods of making such articles.

BACKGROUND

A coated abrasive article comprises a backing material with an abrasive coating on at least one side. The abrasive coating typically comprises abrasive particles in a resin matrix that serves to bond the abrasive particles to the backing material, and may comprise one or more layers.

Coated abrasive articles are available in a wide variety of forms including sheets, discs, and belts. Some coated abrasive articles are intended for hand-held use (including use on hand-held sanding blocks) and others are intended for use on powered sanding tools. From a manufacturing perspective, it can be difficult to adapt the manufacturing process to supply, at a reasonable price, coated abrasive articles in the wide variety of shapes and sizes demanded by end users. Consequently, some manufacturers concentrate on producing only the most widely-used forms of coated abrasive articles with the result that other products are difficult to obtain and/or are comparatively expensive.

With a view to simplifying the supply of coated abrasive sheets to end users, it is known to supply rolls of coated abrasive sheet material from which any required length can be cut. It has also been proposed, in AU 2004100059A (Cetram Pty Limited), to provide a roll of abrasive paper which includes transverse lines of perforations for tearing the paper into smaller portions of a predetermined size. Outside the field of coated abrasives, it is known from U.S. Pat. No. 5,712,210 (Minnesota Mining and Manufacturing Company, Windisch et al) to provide a web of lofty nonwoven surface treatment material with a plurality of longitudinally-spaced and laterally-disposed perforations to permit the web to be separated into a plurality of sheets of abrasive surface treatment material.

SUMMARY

The present invention is concerned with the provision of coated abrasive articles that offer the end user a selection of shapes in which an article can be used and, consequently, are suitable for use in more than one type of abrading operation.

The present invention provides a coated abrasive article comprising a backing having an abrasive coating on one side, wherein a line of weakness is formed in the article that allows the article to be used for its intended purpose but also permits one part of the article to be separated from another part. More specifically, the present invention provides a coated abrasive article comprising a backing having an abrasive coating on one side, wherein a line of weakness is formed in the article that does not penetrate the outer face of the abrasive coating, the line of weakness permitting one part of the abrasive article to be separated from another part.

Abrasive articles in accordance with the invention enable the demand for a variety of abrasive products to be met through the provision of larger abrasive products that are either usable as such or separable, by the customer, into smaller products. The larger products can be produced at lower cost, and result in the use of less packaging material and fewer stock items, and facilitate distribution. In addition, when compared with a coated abrasive articles provided with perforations that pass through the entire thickness of the product and thus penetrate the outer face of the abrasive coating, an abrasive article in accordance with the invention can enable certain disadvantages to be avoided. For example, perforations that penetrate the outer face of the abrasive coating can affect the abrasive function of the coating by creating dust-loading points that may limit the useful life of the product. They can also give rise to rough edges if they define a line along which an abrasive material is torn, which may damage the abrasive coating and again limit the useful life of the product.

The abrasive coating of an abrasive article in accordance with the invention may comprise abrasive particles in a resin matrix. More particularly, the abrasive coating may comprise a make coat resin layer in which the abrasive particles are at least partly embedded; or a resin layer throughout which the abrasive particles are uniformly distributed; or a layer comprising a plurality of shaped composites of abrasive particles in a resin matrix.

The backing of an abrasive article in accordance with the invention, which may be a multi-layer material, may comprise a layer of paper, film, foam or cloth.

An abrasive article in accordance with the invention may also comprise a layer of attachment material on the side of the backing remote from the abrasive coating, for use in attaching the abrasive article to a tool. The attachment layer may be an adhesive layer, or one part of a hook-and-loop attachment system. In an embodiment in which the attachment layer is a loop material, it may be an integral part of the backing or it may be a separate layer that is secured to the backing by an adhesive.

The line of weakness in the abrasive article may comprise perforations in the backing that do not penetrate the front face of the abrasive coating although they may, in some cases, extend into the abrasive coating. The perforations in the backing may be of any suitable shape, including circular, and may be spaced apart by any appropriate distance, the shape and spacing being selected so that the abrasive article remains suitable for its intended purpose but can be modified in shape by separating one part of the article from another part along the line of weakness comprising the perforations.

When the abrasive article comprises a layer of attachment material, the attachment material may be cut through completely along the line of weakness.

An abrasive article in accordance with the invention may comprise a sheet of abrasive material in which are formed a plurality of lines of weakness permitting the sheet to be separated into a plurality of other abrasive articles. At least one of those abrasive articles may include at least one of the said lines of weakness. The abrasive article may, for example, be in the form of a rectangular abrasive sheet with at least one line of weakness permitting the sheet to be separated into smaller rectangular sheets. An abrasive article in accordance with the invention may be in the form of a web of coated abrasive material, which may be provided in the form of a roll.

Preferably, the/each said line of weakness is formed using a laser beam directed towards the backing from the side opposite the abrasive coating. The same laser equipment that is used to form the/each line of weakness may also be used to cut the coated abrasive article from a web of material and/or to cut apertures in the abrasive article thereby enabling the abrasive articles to be produced quickly and efficiently.

It is already known to use lasers to mark or to form cuts in coated abrasive materials, especially for cutting articles of a particular shape from a sheet of material. For example:

WO 01/24971 (3M Innovative Properties Company, Carpentier et al) describes the use of a laser to remove a portion of the abrasive coating of a coated abrasive article to inscribe a detectable marking on the article;

WO 2004/012906 (3M Innovative Properties Company, Paxton et al) refers to the use of laser cutting in the manufacture of a coated abrasive article having an adhesive attachment layer and a removable liner on the surface of the backing opposite the abrasive coating; and WO 2007/021636 (3M Innovative Properties Company, Minick et al) describes a flexible hand-held abrasive article comprising a backing layer with an abrasive surface, in which slits are formed in the backing layer by laser cutting to provide increased flexibility.

The use of laser equipment to manufacture abrasive articles in accordance with the invention enables production to be switched easily from one product to another, thereby facilitating the economic production of comparatively-small quantities of any one product.

BRIEF DESCRIPTION OF THE DRAWINGS

By way of example only, an abrasive article in accordance with the present invention will be described with reference to the accompanying drawings, in which.

DETAILED DESCRIPTION

Figure 1:
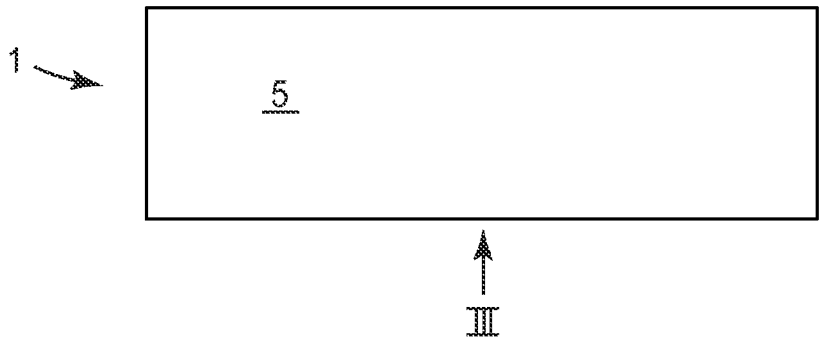
FIG. 1 is a plan view, from the abrasive side, of an abrasive article in accordance with the invention.
Figure 2:
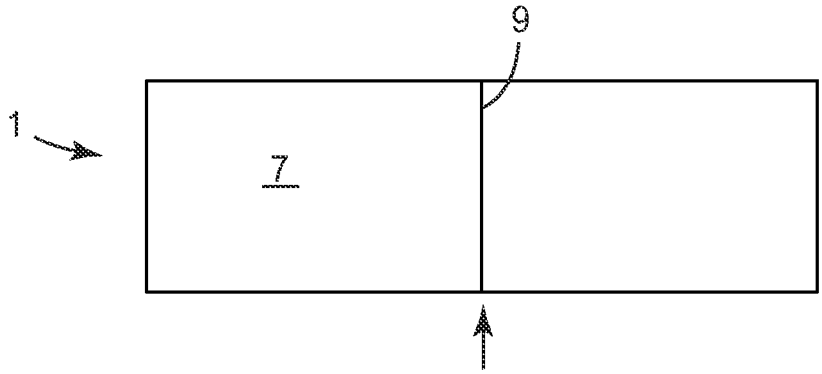
FIG. 2 is a plan view, from the other side, of the abrasive article of FIG. 1.
Figure 3:
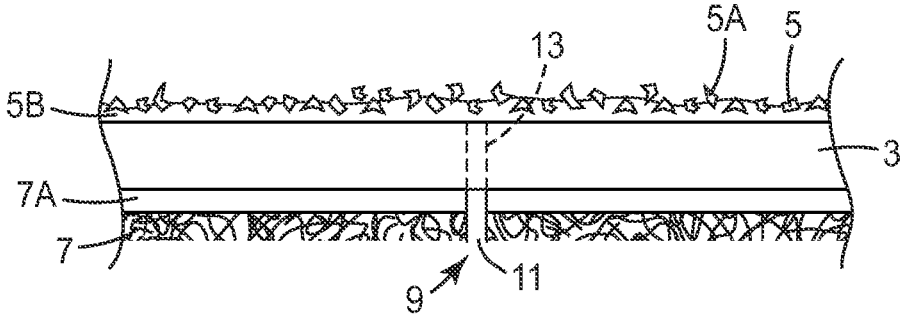
FIG. 3 is a diagrammatic side view on an enlarged scale, in the direction of the arrow III in FIG. 1, of the central part of the abrasive article of FIGS. 1 and 2.

The abrasive article 1 shown in FIGS. 1 to 3 is a rectangular coated abrasive sheet. The article 1 comprises a plurality of layers, primarily (referring to FIG. 3) a backing layer 3, an abrasive coating layer 5 on one side of the backing layer, and an attachment layer 7 on the other side of the backing layer.

The backing layer 3 comprises any sheet material known to be suitable for use in coated abrasive articles, and may be a multi-layer material. Suitable materials include papers, films, cloths and foams of appropriate thicknesses.

The abrasive coating 5 comprises any suitable abrasive particles 5A in any suitable resin matrix 5B that serves to bond the particles to the backing layer 3. The abrasive particles 5A may be of any materials and sizes known to be suitable for use in coated abrasive articles. The resin matrix 5B of the abrasive coating 5 may comprise a conventional make coat into which the abrasive particles are at least partly embedded, and an optional conventional size coat. Other layers conventionally used in coated abrasives may optionally be applied over the make coat or the size coat. Alternatively, the abrasive particles of the abrasive coating 5 may be substantially uniformly distributed throughout the resin matrix: such an abrasive coating could be achieved by applying a slurry of abrasive particles and resin to the backing layer 3. As a further alternative, the abrasive coating 5 may comprises a plurality of shaped composites of abrasive particles in a resin matrix. Examples of such shaped composites are described in U.S. Pat. No. 5,152,917 (Pieper et al).

The abrasive particles and the resin matrix will both be selected, as is well understood, having regard to the intended use of the abrasive sheet 1.

The attachment layer 7 comprises any material suitable for attaching the abrasive article 1 to a tool such as a hand-held block or a powered sanding tool. Such attachment materials are well known. As illustrated, the layer 7 is the loop part of a hook-and-loop attachment system but it could, for example, be a layer of pressure-sensitive adhesive, or part of an intermeshing attachment system. In the present case, the loop attachment layer 7 is a separate layer that is laminated to the backing layer 3 by an adhesive layer 7A, but it may alternatively be an integral part of the backing layer.

As so far described, the abrasive article 1 is a conventional abrasive sheet suitable, for example, for hand-held use to abrade a surface. The abrasive sheet may be held directly in the hand or it may be attached to a hand sanding block of any suitable type.

To increase the versatility of the abrasive sheet 1, it is provided with a line of weakness 9 extending across the sheet at its mid-point, on the side of the attachment layer 7, from one side edge of the sheet to the other. Within the attachment layer 7, the line of weakness 9 has the form of a cut 11 extending completely through the attachment layer whereas, within the backing layer 3, the line of weakness 9 has the form of a line of perforations 13 (i.e. a line of spaced through-holes in the backing layer) that preferably do not penetrate into the abrasive coating 5. Despite the presence of the line of weakness 9, further details of which will be provided below, the abrasive sheet 1 remains suitable for the intended hand-held use referred to above. On the other hand, if the abrasive sheet is folded through 180° along the line of weakness 9, to bring the abrasive coatings 5 on the two parts of the sheet together, it can be separated cleanly into two smaller rectangular sheets each of which is also suitable for hand-held use either directly or on a smaller hand sanding block.

The abrasive sheet 1 thus effectively provides two products i.e. the larger abrasive sheet 1 as shown or two smaller abrasive sheets. A manufacturer can therefore satisfy the demand for both products by producing and supplying just one product.

The line of weakness 9 is advantageously formed in the abrasive sheet 1 using a beam of laser energy that is focussed, or tuned, so that it will only penetrate to a certain depth within the coated abrasive material: that depth can readily be determined for any particular material by experimentation and, if required, changed by adjusting the output power of the laser.

A preferred method of forming the line of weakness 9 using a laser beam is to determine the laser operating parameters required (i) to cut through the attachment layer 7 without penetrating the backing layer 3 of the abrasive sheet 1, and (ii) to cut through the attachment layer 7 and produce a perforation in the backing layer 3 without penetrating the abrasive coating 5. The operating parameters may, for example, be the power of the laser beam or a combination of the power of the laser beam and the speed at which it is moved relative to the abrasive sheet 1. The line of weakness 9 is then produced by moving the laser beam across the width of the sheet 1 directed at the attachment layer 7, and using the operating parameters (i) and (ii) alternately over respective appropriate distances x and y. The result will be a continuous cut 11 through the attachment layer 7 of the sheet 1, and perforations 13 of a length y in the backing layer 3, spaced apart by a distance of x. The distances x and y required to enable the sheet 1 to be separated into two parts as described above can readily be determined by experimentation for any particular type of abrasive sheet. Alternatively, the line of weakness 9 can be produced using multiple superposed laser beams, either simultaneously or sequentially. For example, the continuous cut 11 in the attachment layer 7 can be produced during a first movement of a laser beam across the width of the sheet 1, with the perforations 13 being produced during a subsequent movement of a laser beam across the sheet.

In some cases, depending on the nature of the abrasive sheet 1, it may be found necessary for the continuous cut 11 and/or the perforations 13 to penetrate more deeply into the sheet, although without penetrating the front face of the abrasive coating 5, to enable the sheet to be separated cleanly into two parts. For example, the continuous cut 11 may extend into, or through, the adhesive layer that secures the attachment layer 7 to the backing layer 3, and may even extend partially into the backing layer. Likewise, the perforations 13 in the backing layer 3 may extend partially into the abrasive coating 5 although care should be taken to ensure that they do not penetrate the front face of the abrasive coating 5. Generally, it has been observed that coarser-grade abrasive sheets, which tend to be more brittle, separate more easily along a line of weakness and require the cut 11 and/or the perforations 13 to extend less deeply into the sheet.

If the attachment layer 7 is omitted from the abrasive sheet 1, it may be sufficient for the line of weakness 9 to consist only of the perforations 13 in the backing layer 3 of the sheet (possibly extending, as described above, into the abrasive coating 5 without penetrating the front face thereof).

Figure 4:
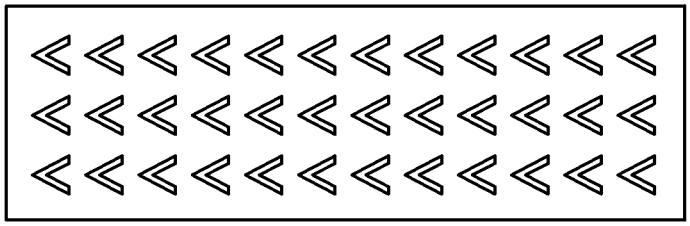
FIG. 4 is a plan view of another abrasive article in accordance with the invention, which can be made by a process using the same equipment as that used to produce the article of FIGS. 1 to 3.

The laser equipment used to carry out the process described above may also be used to cut a plurality of the abrasive sheets 1 from a web of coated abrasive material and/or to cut one or more apertures in the abrasive sheet, if required. All of the laser cutting operations may be carried out during one passage of the web of coated abrasive material relative to the laser equipment, thereby enabling the abrasive sheets to be produced quickly and efficiently. FIG. 4 shows, by way of example, an abrasive sheet similar to that of FIG. 1, in which chevron-shaped apertures 15 have also been cut in the sheet by the laser equipment used to produce the line of weakness 9.

In comparison to a mechanical cutting operation which requires the use of carefully-constructed dies to produce a particular product, laser equipment can be switched easily from the manufacture of one product to another, thereby enabling comparatively-small quantities of any one product to be produced economically. However, although the use of laser equipment is advantageous, the use of mechanical cutting equipment to produce abrasive articles in accordance with the invention is not excluded.

Any suitable laser equipment can be used to carry out the process described above including, for example, known $CO_2$ lasers. In order to provide rapid processing, the power and/or speed at which the equipment is operated should be optimized having regard to the material that is being processed. An example of suitable laser equipment is that available, under the trade designation "SCX600", from ROFIN-SINAR Technologies, Inc. of Plymouth, Mich. 48170, USA, which provides a focussed laser beam of about 0.25 mm diameter. Using equipment of that type, lines of weakness were produced in three different grades of abrasive sheet (P400, P180 and P80) available under the trade designation "Hookit™ 334U" from 3M Company of St. Paul, Minn., U.S.A. (having an attachment layer 7 of looped knit fabric adhesively-attached to a backing layer 3 of paper, and an abrasive coating 5 comprising aluminium oxide abrasive particles). The laser beam was moved across the width of the sheets at a speed of about 380 cm/s, directed at the attachment layer 7, using alternately a lower-power pulse for a distance of about 1.5 mm and a higher-power pulse for a distance of about 0.75 mm. The pulses were set respectively at 27% and 35% power for the P400 grade sheets; 27% and 46% power for the P180 grade sheets; and 25% and 27% power for the P80 grade sheets. The size of the abrasive sheets was 40.64 cm (16 inches) by 7.0 cm and the line of weakness produced in each sheet enabled it to be separated into two sheets each of 20.32 cm (8 inches) by 7.0 cm. Both sizes of sheet were found to be suitable for use by hand and on hand sanding blocks of an appropriate size. In particular, the larger sheets could be used by hand and/or on sanding blocks without damaging the sheets at the lines of weakness.

It will be understood that other coated abrasive articles can be formed with lines of weakness as described above. For example, a suitably-shaped abrasive sheet provided with at least one longitudinally-extending line of weakness may be formed into an abrasive belt by joining the two free ends of the sheet together in known manner. In that case, suitably-positioned lines of weakness enable alternative widths for the belt to be selected.

Figure 5A:
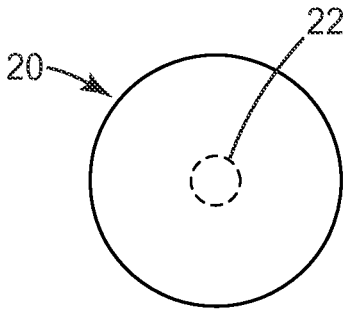
FIGS. 5A and B show other abrasive articles in accordance with the present invention.
Figure 5B:
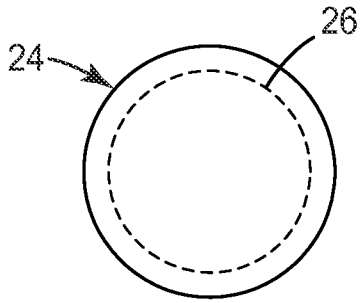

FIGS. 5A and 5B show other coated abrasive articles in accordance with the invention. Both articles are in the form of abrasive discs suitable for attachment to a powered sanding tool. The abrasive disc 20 of FIG. 5A has a circular line of weakness 22 defining a circular region that can be removed to provide a central hole in the disc, and the abrasive disc 24 of FIG. 5B has a line of weakness 24 defining a peripheral rim that can be removed to form a disc of smaller diameter. As a further alternative, a plurality of circular lines of weakness could define circular regions that can be removed to provide dust-extraction holes in an abrasive disc. As yet another alternative, a web of coated abrasive material (which could be provided in the form of a roll) may comprise a plurality of lines of weakness permitting the sheet to be separated into a plurality of abrasive articles. At least one of those abrasive articles may itself comprise at least one line of weakness. In all cases, a line of weakness will permit the abrasive article in which it is formed to be used for its intended purpose but will also permit one part of the abrasive article to be separated from another part.

When compared with perforations that pass through the entire thickness of a coated abrasive material, a line of weakness 9 as described above offers certain advantages. Perforations that penetrate the front face of the abrasive coating, if they are present in a working area of the coating, may create dust-loading points which can limit the useful life of an abrasive product. A line of weakness 9 as described above, on the other hand, enables that effect to be avoided. Moreover, if an abrasive material is torn along a line of conventional perforations penetrate the entire thickness of the material, there is a high likelihood that rough edges will be formed, which can damage the abrasive coating 5 and again limit the useful life of the product. A line of weakness 9 as described above, on the other hand, enables abrasive material to be separated cleanly.

Abrasive articles with lines of weakness as described above allow customer demands to be met through the provision of larger abrasive products which are either usable as such or separable, by the customer, into smaller products. The larger products can be produced at lower cost, and result in the use of less packaging material and fewer stock items, and facilitate distribution.

The present invention has now been described with reference to one embodiment and possible modifications thereof. It will be apparent to those skilled in the art that many changes can be made in the embodiments described without departing from the scope of the present invention.

What is claimed is:

1. A coated abrasive article comprising a backing having an abrasive coating on one side, the abrasive coating comprising an outer face;

an attachment layer on the other side of the backing, the attachment layer comprising a loop material;

wherein a line of weakness is formed in the article that penetrates through the attachment layer but does not penetrate the outer face of the abrasive coating, the line of weakness permitting one part of the abrasive article to be separated from another part.

2. An abrasive article as claimed in claim 1, in which the line of weakness comprises perforations in the backing that do not penetrate the outer face of the abrasive coating.

3. An abrasive article as claimed in claim 1, in which the backing comprises a material selected from the group consisting of paper, film, foam, cloth and combinations thereof.

4. An abrasive article as claimed in claim 1, in which the abrasive coating comprises abrasive particles in a resin matrix, and the line of weakness does not extend into the resin matrix.

5. An abrasive article as claimed in claim 1, in which at least one of the two said parts is a further abrasive article.

6. An abrasive article as claimed in claim 1, the article being in the form of a rectangular abrasive sheet and the line of weakness being positioned to permit the sheet to be separated into smaller rectangular sheets.

7. An abrasive article as claimed in claim 1, the article being in the form of an abrasive disc and the line of weakness being positioned to permit part of the abrasive disc to be removed to leave an alternative form of abrasive disc.

8. A method of making an abrasive article comprising providing a coated abrasive article comprising a backing having an abrasive coating on one side and an attachment layer comprising a loop material on the other side, the abrasive coating comprising an outer face; and directing a laser beam towards the backing from the side opposite the abrasive coating to form a line of weakness in the coated abrasive article that does not penetrate the outer face of the abrasive coating, the line of weakness permitting one part of the abrasive article to be separated from another part.

9. A method as claimed in claim 8, including the step of controlling the laser beam to produce perforations in the backing that do not penetrate the outer face of the abrasive coating.

10. A method as claimed in claim 9, in which the perforations are produced in the backing without penetrating the abrasive coating.

11. A method as claimed in claim 8, in which the laser beam is produced by a $CO_2$ laser.

12. A method as claimed in claim 8, in which the laser beam is also used to cut the article from a web of coated abrasive material and/or to cut apertures in the abrasive article.

13. A method of making an abrasive article comprising providing a coated abrasive article comprising a backing having an abrasive coating on one side and an attachment layer comprising a loop material on the other side, the abrasive coating comprising an outer face; and directing a laser beam towards the backing from the side opposite the abrasive coating to form a line of weakness in the coated abrasive article that cuts through the attachment layer and produces perforations in the backing, but does not penetrate the outer face of the abrasive coating, the line of weakness permitting one part of the abrasive article to be separated from another part.

* * * * *